US011932477B2

(12) United States Patent
Zaremski

(10) Patent No.: US 11,932,477 B2
(45) Date of Patent: Mar. 19, 2024

(54) QUILT STORAGE BAG

(71) Applicant: Mark Zaremski, Downers Grove, IL (US)

(72) Inventor: Mark Zaremski, Downers Grove, IL (US)

( * ) Notice: Subject to any disclaimer, the term of this patent is extended or adjusted under 35 U.S.C. 154(b) by 368 days.

(21) Appl. No.: 15/964,244

(22) Filed: Apr. 27, 2018

(65) Prior Publication Data

US 2018/0334315 A1 Nov. 22, 2018

Related U.S. Application Data

(60) Provisional application No. 62/508,144, filed on May 18, 2017.

(51) Int. Cl.

| | |
|---|---|
| ***B65D 85/07*** | (2017.01) |
| ***B65D 6/18*** | (2006.01) |
| ***B65D 30/08*** | (2006.01) |
| ***B65D 37/00*** | (2006.01) |
| ***B65D 57/00*** | (2006.01) |
| ***B65D 65/10*** | (2006.01) |
| ***B65D 85/18*** | (2006.01) |

(52) U.S. Cl.

CPC ..... *B65D 85/07* (2018.01); *B65D 11/1853* (2013.01); *B65D 29/02* (2013.01); *B65D 37/00* (2013.01); *B65D 57/003* (2020.05); *B65D 65/10* (2013.01); *B65D 85/18* (2013.01)

(58) Field of Classification Search

CPC ..... B65D 85/07; B65D 85/18; B65D 29/02; A45C 13/02; A45C 7/0095

See application file for complete search history.

(56) References Cited

U.S. PATENT DOCUMENTS

| | | | | | |
|---|---|---|---|---|---|
| 1,208,221 | A * | 12/1916 | Simons | B65D 85/18 | 206/288 |
| 2,082,011 | A * | 6/1937 | Lee | A45C 13/02 | 206/293 |
| 3,944,032 | A * | 3/1976 | Samhammer | A45C 5/06 | 206/292 |
| 5,054,589 | A * | 10/1991 | Bomes | A45C 13/02 | 190/18 A |
| 5,150,776 | A * | 9/1992 | Rebenack | A45C 13/02 | 190/110 |
| 6,161,959 | A * | 12/2000 | Abraham | A44B 19/301 | 24/387 |
| 6,237,761 | B1 * | 5/2001 | Godshaw | A45C 3/004 | 206/278 |
| 7,153,025 | B1 * | 12/2006 | Jackson | A45C 7/0059 | 383/2 |
| 2004/0200094 | A1 * | 10/2004 | Baychar | A43B 1/0045 | 36/55 |

* cited by examiner

*Primary Examiner* — Anthony D Stashick
*Assistant Examiner* — Blaine G Neway
(74) *Attorney, Agent, or Firm* — Paulcy Erickson & Swanson

(57) ABSTRACT

The present invention is directed to a bag for storing quilts, afghans, linens, blankets, hand-made clothing and other hand-made items. The present invention is further directed to a novel method of folding the item using interior flaps to protect the item. The storage bag of this invention includes an outer layer comprising a breathable, non-woven material, an interior layer that prevents damaging the quilt, a non-snagging sliding fastener proving access to an interior of the bag, and one or more interior flaps to protect the folded item.

6 Claims, 4 Drawing Sheets

QUILT STORAGE BAG

CROSS REFERENCE TO RELATED APPLICATION

This application claims the benefit of U.S. Provisional Patent Application Ser. No. 62/508,144, filed on 18 May 2017. The co-pending Provisional Application is hereby incorporated by reference herein in its entirety and is made a part hereof, including but not limited to those portions which specifically appear hereinafter.

BACKGROUND OF THE INVENTION

Field of the Invention

This invention relates generally to a storage bag for protecting and preventing damage to quilts, afghans, linens, blankets, hand-made clothing and other hand-made items.

Discussion of Related Art

Hand-made items, such as quilts, afghans, linens, blankets, clothing and other items, require a great deal of skill, effort, and time to create. As a result, these hand-made items are often prized possessions that are passed down as heirlooms. As such, these items must be carefully stored when not in use to prevent damage. Previously known method for storing these items include storing in cardboard boxes, pillow cases and zippered vinyl duvet bags. However, cardboard boxes and pillow cases cannot protect the hand-made item from water damage and vinyl bags release chemicals that can discolor or otherwise damage the item. Furthermore, none of these known devices protect the hand-made item from damage as the item is folded against itself.

As such, there is a need for an improved storage bag for quilts, afghans, linens, blankets, clothing, and other hand-made items.

SUMMARY OF THE INVENTION

An objective of the present invention is to provide a storage bag to protect household goods and hand-made items, such a quilts, afghans, blankets, linens and clothing from damage. The storage bag of this invention is ideal for storage, gift giving, or works-in-progress. Ideally, the storage bag of this invention is breathable while also protecting quilts and other hand-made items from damage from dirt, dust, moisture, mildew, insects and other contaminants. The storage bag also prevents damage from handling.

According to an embodiment of the invention, the storage bag is a rectangular shaped bag with a top closable with a non-snagging zipper closure or another type of fastening device. The rectangular shape may comprise any size for the storage of different sized quilts. Alternatively, the bag may comprise any shape and not necessarily rectangular and may include another type of access to an interior of the bag. Preferably, the bag is made from a non-woven fabric that is breathable while protecting an interior from moisture, dirt, dust, moisture, mildew, insects, and other contaminants. For example, the bag may be made from non-woven polypropylene. However, it should be understood that the bag of this invention is not limited to this material.

The bag may comprise walls having one or more layers. In one embodiment the bag includes two layers and outer layer providing protection from external contaminants and an inner layer protecting the stored item from friction damage that may cause pilling or other types of damage.

In a preferred embodiment, the storage bag of this invention includes interior flaps that may be positioned between layers of a folded item to further protect the item from damage. In one embodiment, the interior flaps may be sewn into a lower seam of the rectangular box, preferably with the interior flaps joined to opposing lower seams to overlap with one another.

The bag of this invention may further include a handle and/or a card holder for easy identification of the contents without opening the bag.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
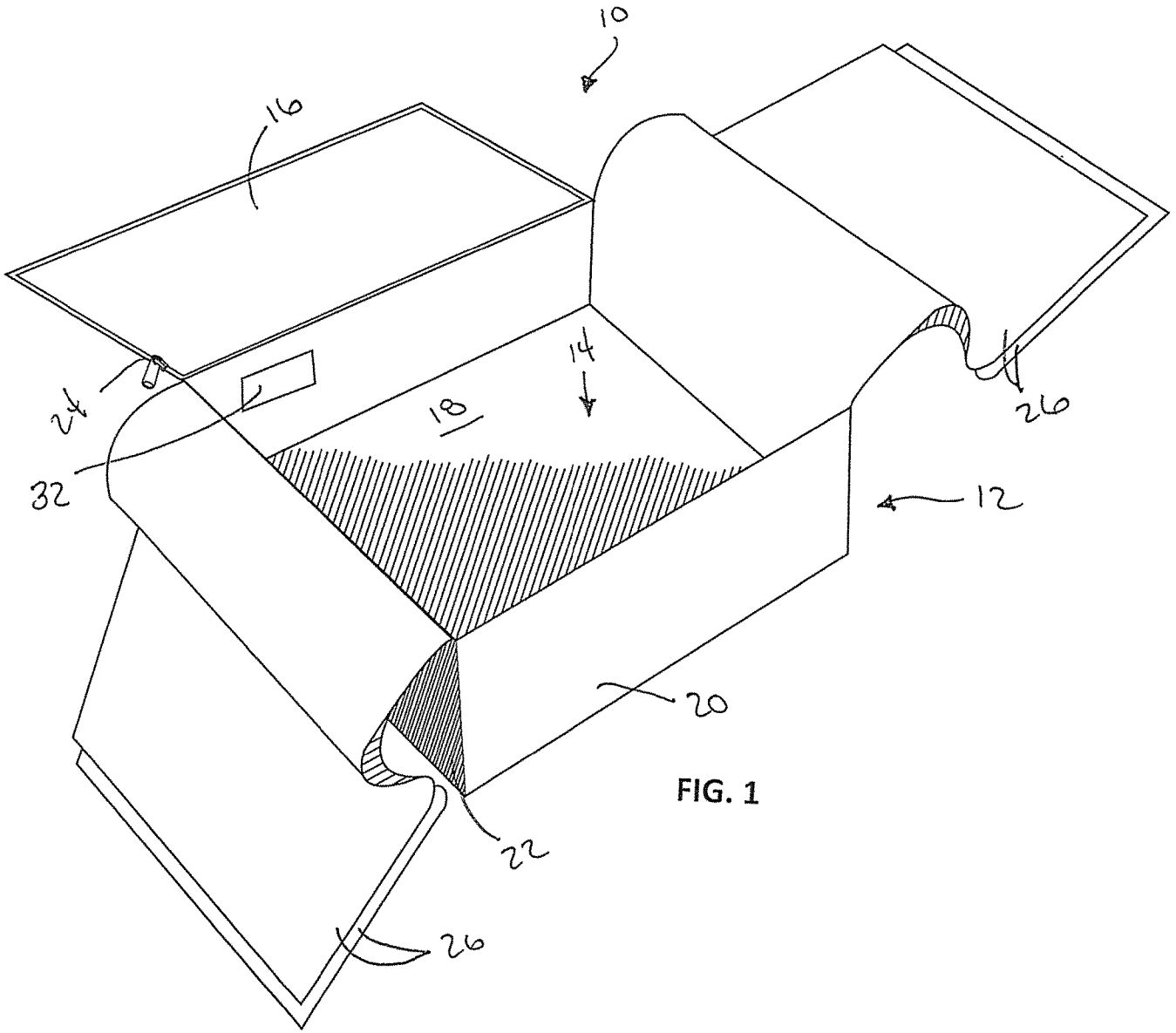
FIG. 1 shows a perspective view a storage bag according to one embodiment of this invention with a top un-zipped and open and interior flaps folded outward.
Figure 2:
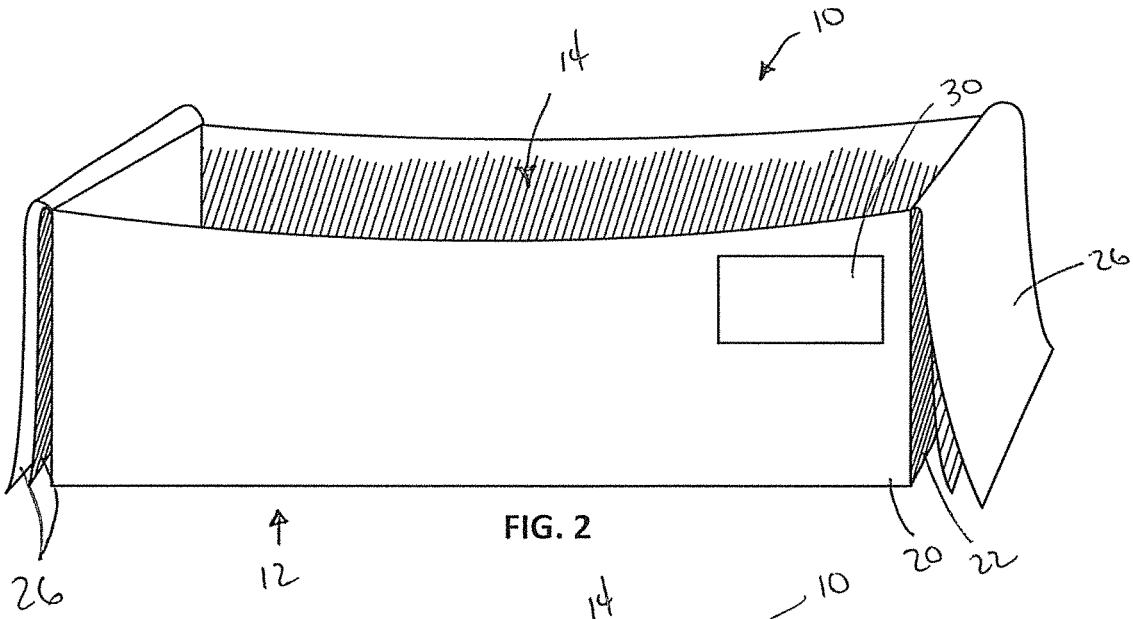
FIG. 2 shows a front perspective view of the storage bag of FIG. 1.
Figure 3:
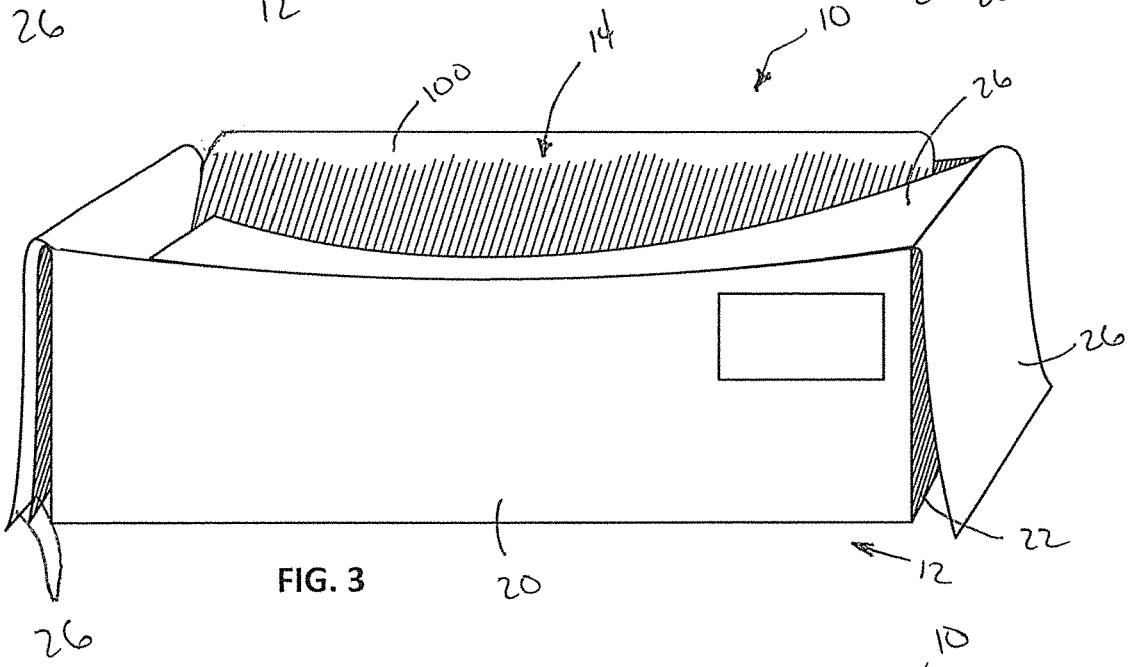
FIG. 3 shows a front perspective view of the storage bag of FIG. 1 with a folded quilt partially positioned within the storage bag and with a flap positioned over a portion of the folded quilt.
Figure 4:
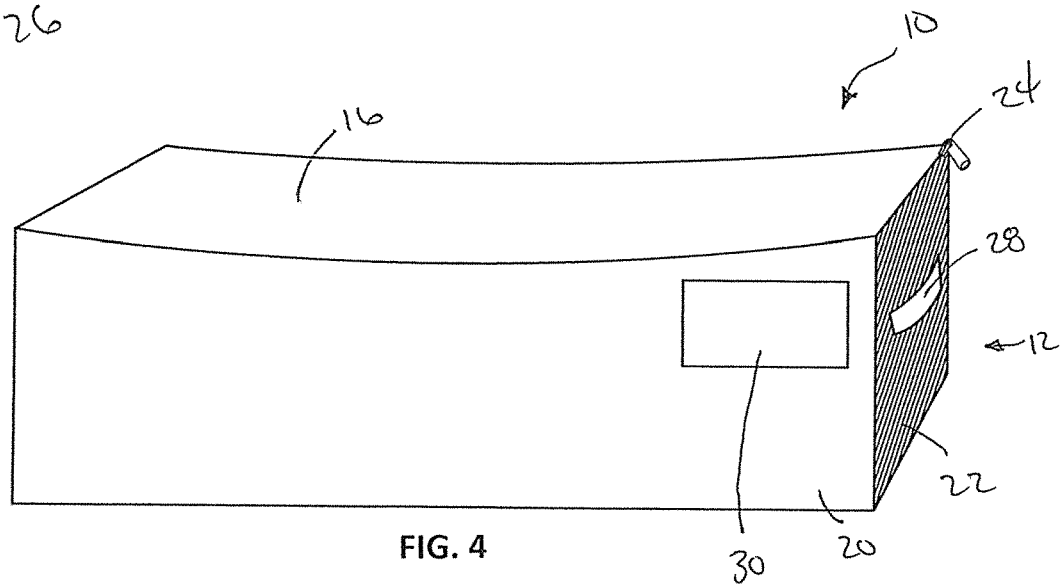
FIG. 4 shows a front perspective view of the storage bag of FIG. 1 with the top closed.

The present invention is directed to a storage bag 10 for storing and preventing damage to household goods, and especially hand-made items, including, but not limited to, quilts, linens, afghans, hand-made clothing, knitted items, and other similar items. The present invention is also directed to a method of using the storage bag to protect a folded item 100. For ease of explanation, the remaining description will be described in connection with storing and protecting quilts however it should be understood that the invention of this application is not limited to quilts.

In one embodiment of the invention, shown in FIGS. 1-4, the storage bag 10 comprises a rectangular-shaped body 12 that is sized to fit a quilt in an interior 14. In this embodiment, the storage bag 10 overall measures 16"×24"×9" sufficient to store a king-sized quilt. In this embodiment, the storage bag 10 has a relatively large rectangular top 16 and bottom 18 compared with the slender sides 20, 22 providing a narrow profile allowing the bag 10 to store the king-sized quilt while also fitting under a bed or in a closet. In alternative embodiments, the storage bag may comprise other shapes and/or dimensions necessary to store items of various dimensions.

As shown in FIG. 1, the top 16 of the storage bag is integral with one of the sides 20 and is attached to the other three sides 20, 22 with a slide fastener 24, also known as a zipper. The slide fastener 24 is preferably is a non-snagging closure that minimizes a possibility of the slide fastener 24 damaging the stored quilt. Alternatively, other types of fasteners may be used including, but not limited to, buttons, snaps, hook & loop fasteners, and press & seal closures (similar to Ziploc™) may be used.

In a preferred embodiment, the storage bag 10 is made from a non-woven fabric that is breathable while protection the interior 14 from moisture, dirt, dust, mildew, insects, UV, and other contaminants. For example, in an embodiment, the storage bag 10 may be made from non-woven polypropylene. However, it should be understood that the bag 10 of this invention is not limited to this material.

In a preferred embodiment of this invention, the storage bag 10 include one or more interior flaps 26 that may be positioned between layers of a folded quilt 100 during storage to further protect the quilt from damage. The interior flaps 26 are preferably made of a material that will not damage the quilt stored within the bag 10. For example, the flaps 26 may be made from the following materials: non-woven polypropylene, acid-free paper and/or non-woven acid free cellulose fiber. However, it should be understood that the interior flaps 26 are not limited to these materials and may be made of other materials.

Figure 5:
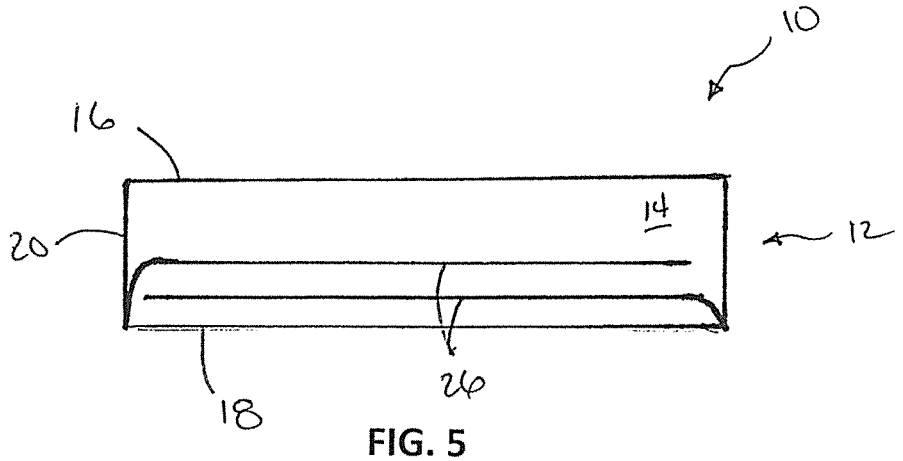
FIG. 5 shows a cross-sectional view of the storage bag according to another embodiment of this invention with two interior flaps.
Figure 6:
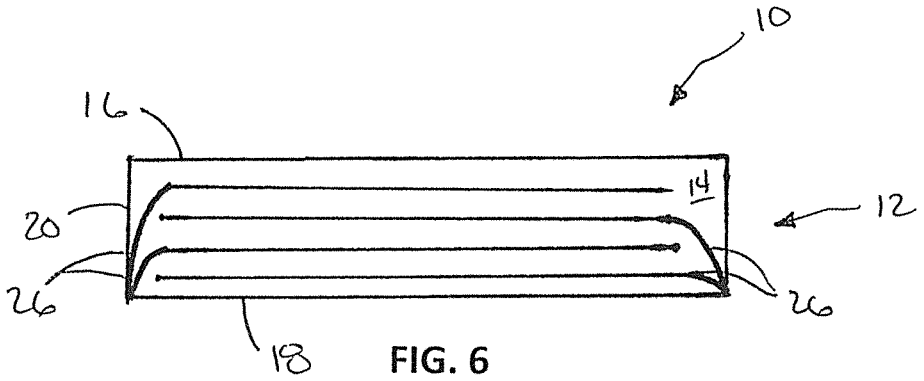
FIG. 6 shows a cross-sectional view of the storage bag according to another embodiment of this invention with four interior flaps.
Figure 7:
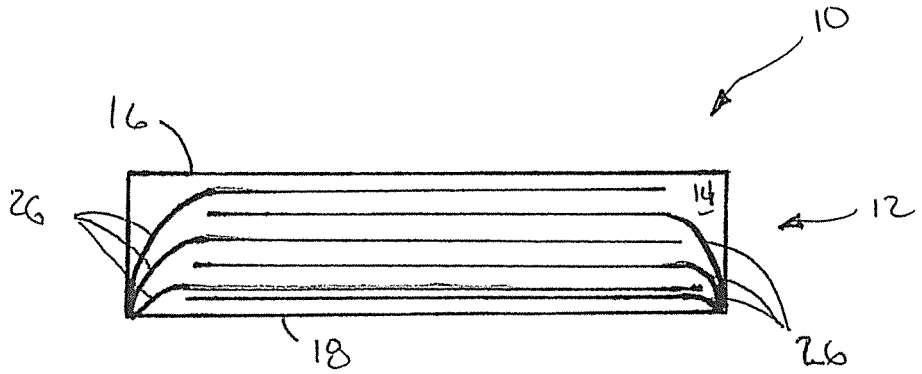
FIG. 7 shows a cross-sectional view of the storage bag according to another embodiment of this invention with six interior flaps.

FIGS. 5-7 show multiple embodiments of the storage bag 10 of this invention having two, four, or six interior flaps 26. Please note, alternative embodiments of this invention may include an odd number of flaps 26 and/or more than six flaps 26 or even a single flap 26. In the embodiments of FIGS. 5-7, the interior flaps 26 are sewn into a lower seam of the rectangular body 12. However, in alternative embodiments, the interior flaps 26 may not be connected to the storage bag 10 at the lower seam and may be attached at an upper portion of the interior or at any location within the interior 14 of the storage bag 10. Preferably, the interior flaps 26 are attached at a position that best allows the flaps 26 to protect the item 100 being stored within the storage bag 10. In a preferred embodiment, the interior flaps 26 have different dimensions depending on how each flap is positioned with respect to the stored item. For example, in the six layer embodiment shown in FIG. 7, bottom layers are sized as 24.5"×16", middle layers are sized as 25"×16" and top layers are sized as 26"×16". However, it should be understood that he interior flaps 26 may comprise consistent dimensions. Alternatively, the interior layers may comprise various shapes and dimensions depending on the item 100 stored within the storage bag 10.

The bag 10 of this invention may further include a handle 28 on one or more sides 20, 22 of the storage bag 10 to allow for carrying the bag or retrieving the bag from under a bed, in a closet or on a shelf.

The bag 10 of this invention may also include a clear card holder 30 for easy identification of the contents without opening the bag.

The bag of this invention may further include an internal pocket 32 in the interior of the bag to hold a silica gel pack, or another similar moisture and/or odor absorbing packet, to keep moisture and odors out of the storage bag 10. The internal pocket 32 preferably is a mesh or otherwise breathable fabric which allows for airflow between an interior of the internal pocket 32 and the interior 14 of the bag 10. In an embodiment, the interior pocket 32 includes a zipper or another type of closure device.

Figure 8:
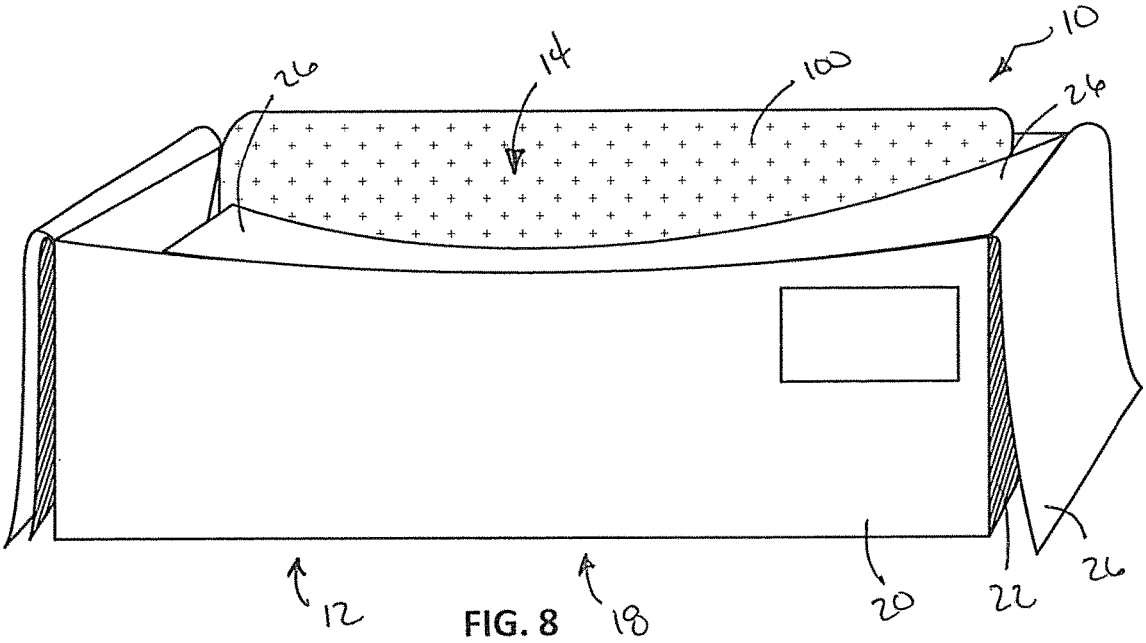
FIG. 8 shows a perspective view the storage bag according to another embodiment of this invention with the top open and a folded quilt partially positioned within the storage bag and with one flap positioned over a portion of the folded quilt.
Figure 9:
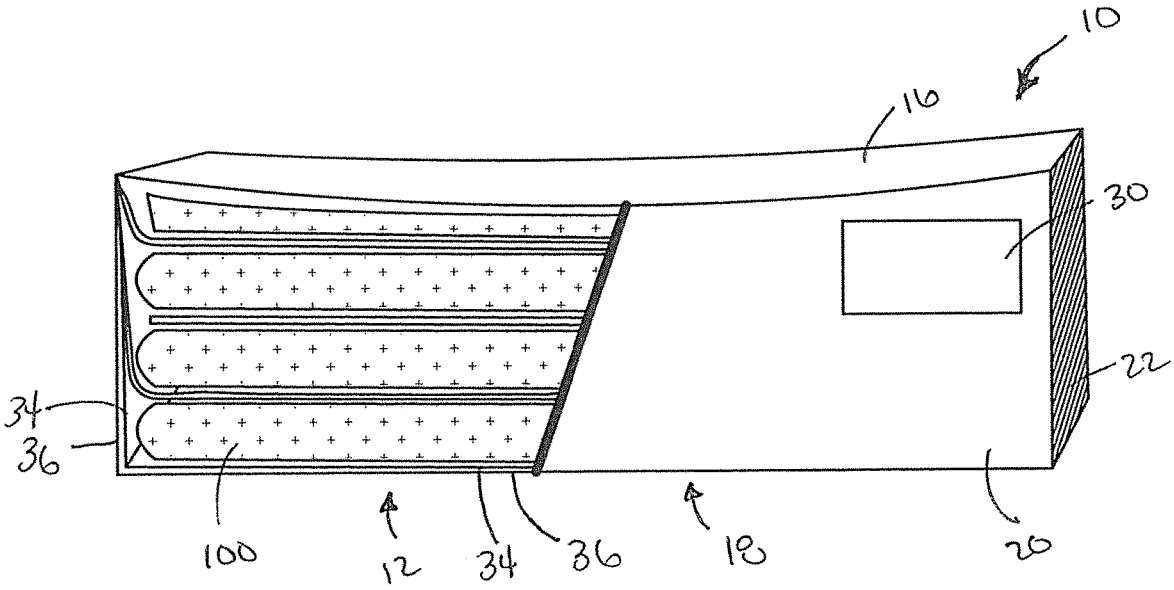
FIG. 9 shows a partial sectional view of the storage bag of FIG. 8 with the folded quilt positioned in an interior and with the top closed.

In another embodiment of the invention, as shown in FIGS. 8 and 9, the walls of the storage bag 10 may include a plurality of layers 34, 36. For example, as best shown in the cross-sectional view of FIG. 9, the storage bag 10 includes an outer layer 36 providing protection from external contaminants and an inner layer 34 protecting the stored item 100 from friction damage that may cause pilling or other types of damage. In an embodiment of this invention, the outer layer 36 may comprise the non-woven fabric described earlier in this application and the inner layer 34 may comprise at least one of non-woven polypropylene, non-woven acid free cellulose fiber, acid-free paper, other non-woven materials and/or 100% cotton materials. However, it should be understood that the inner layer 34 is not limited to these materials. In an alternative embodiment, the inner layer 34 and the outer layer 36 may comprise the same type of material.

Utilization of the storage bag 10 starts by opening the top 16 and folding the interior flaps 26 from the interior 14, as shown in FIG. 1. With the quilt 100 to be stored folded in a long narrow arrangement, a first end of the quilt 100 is positioned within the storage bag 10. One of the bottom interior flaps 26 is then folded into the interior 14 over the first end of the quilt 100. The quilt 100 is then folded back on itself toward the first end of the quilt and the second interior flap 26 is placed over the quilt 100. The quilt 100 is then folded back on itself and the third interior flap 26 is placed over the quilt 100. This process repeats until the quilt 100 is entirely within the interior 14 of the storage bag 10. The storage bag 100 is then closed with the fastener 24 to pack the quilt 100 therein, protecting the quilt from damage caused by dirt, dust, moisture, mildew, insects, UV light, and handling. The cross-sectional view of FIG. 9 shows the quilt 100 stored within the storage bag 10.

Thus, the invention provides a storage bag for protecting quilts and other delicate or hand-made items.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A storage bag for a foldable blanket, the storage bag comprising:

a body comprising a top, a bottom, and a plurality of sides, wherein the bottom and the plurality of sides form an interior space with an opening and the top is attached to one of the plurality of sides, and wherein the top, the bottom, and the plurality of sides comprise at least one of a non-woven polypropylene, an acid-free paper and a non-woven acid free cellulose fiber;

a releasable fastener for releasably connecting the top to one or more of the plurality of sides to enclose the interior space for storing the blanket;

at least two interior flaps made of a flexible material, wherein each flap of the at least two interior flaps comprise a first end permanently attached to the body and sewn where the bottom of the body meets a side of the plurality of sides, and wherein each flap of the at least two interior flaps comprise a free end, opposite the first end, in the interior space;

wherein the flexible material comprises one of a non-woven polypropylene, an acid-free paper and a non-woven acid free cellulose fiber; and wherein the blanket is configured to be folded and positioned in the interior space and the free ends of the at least two interior flaps are positioned between layers of the folded blanket to protect the blanket.

2. The storage bag for a foldable blanket according to claim 1, further comprising four interior flaps made of the flexible material permanently attached to the body and sewn in the interior space, wherein a first flap and a second flap of the four interior flaps protrude from a first side of the interior space, and wherein a third flap and a fourth flap of the four interior flaps protrude from a second side of the interior space, wherein the second side is opposite the first side.

3. The storage bag for a foldable blanket according to claim 2, wherein a first layer of the folded blanket is positioned underneath the first flap, wherein a second layer of the folded blanket is positioned between the first flap and the third flap, wherein a third layer of the folded blanket is positioned between the third flap and the second flap, and wherein a fourth layer of the folded blanket is positioned between the second flap and the fourth flap.

4. The storage bag for a foldable blanket according to claim 2 wherein a top layer of the folded blanket is positioned on top of the four interior flaps.

5. The storage bag for a foldable blanket according to claim 2 wherein the first flap comprises a length and a width, wherein the second flap comprises a length and width, and wherein the length of the second flap is greater than the length of the first flap.

6. The storage bag for a foldable blanket according to claim 2 wherein the third flap comprises a length and a width, wherein the fourth flap comprises a length and width, and wherein the length of the fourth flap is greater than the length of the third flap.

* * * * *